US010065203B2

(12) United States Patent
Moretti

(10) Patent No.: US 10,065,203 B2
(45) Date of Patent: Sep. 4, 2018

(54) DEVICE FOR CONTAINING A FLUID SUBSTANCE

(71) Applicant: LUMSON S.P.A., Capergnanica (CR) (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 303 days.

(21) Appl. No.: 14/887,920

(22) Filed: Oct. 20, 2015

(65) Prior Publication Data

US 2016/0107181 A1 Apr. 21, 2016

(30) Foreign Application Priority Data

Oct. 21, 2014 (IT) ..... MI2014A1814

(51) Int. Cl.
*B05B 11/00* (2006.01)
*B65D 33/00* (2006.01)
*B65D 77/06* (2006.01)

(52) U.S. Cl.
CPC ..... *B05B 11/0037* (2013.01); *B05B 11/0043* (2013.01); *B05B 11/3047* (2013.01); (Continued)

(58) Field of Classification Search
CPC ..... B05B 11/0043; B05B 11/004; B05B 11/0037; B05B 11/3047; B65D 33/00; B65D 83/0055; B65D 77/04; B65D 77/06
See application file for complete search history.

(56) References Cited

U.S. PATENT DOCUMENTS 3,420,413 A * 1/1969 Corsette ..... B05B 11/0043 222/107
2006/0151419 A1 7/2006 Kneer
(Continued)

FOREIGN PATENT DOCUMENTS

EP 2243557 A1 10/2010
FR 2853633 A1 10/2004
(Continued)

OTHER PUBLICATIONS

EP Search Report dated Jun. 9, 2015 for Italian Patent Application No. MI2014A001814 to LUMSON S.p.A. filed Oct. 21, 2014.

*Primary Examiner* — J. Casimer Jacyna
(74) *Attorney, Agent, or Firm* — Vorys, Sater, Seymour and Pease LLP

(57) ABSTRACT

The device for containing fluid substance to be dispensed by manually operated pump, for associating with a rigid container neck, includes a bag having body and neck from which connection flange extends transversally, and a ring cap including bag first connector having an annular connection body, presenting a longitudinal symmetry axis. The annular connection body has a lower portion having a diameter smaller than the bag flange external diameter, and bigger than or equal to the bag neck external diameter; and an upper portion having an annular seat open on the top, having a rest surface lying horizontally for the connection flange.

The connection body includes a substantially cylindrical wall and a guide element to guide at least a portion of the flange from a lower free edge of the connection body to the annular seat and prevent the flange (4) from slipping out of the annular seat.

13 Claims, 7 Drawing Sheets

(52) U.S. Cl.
CPC ..... *B65D 33/00* (2013.01); *B65D 77/06* (2013.01); *B05B 11/3023* (2013.01); *B05B 11/3074* (2013.01)

(56) References Cited

U.S. PATENT DOCUMENTS

| | | | | |
|---|---|---|---|---|
| 2007/0007307 | A1* | 1/2007 | Bohnisch | B05B 11/0043 222/321.9 |
| 2009/0014470 | A1* | 1/2009 | Lin | B05B 11/0043 222/95 |
| 2009/0014471 | A1* | 1/2009 | Lin | A47K 5/122 222/96 |
| 2010/0044393 | A1 | 2/2010 | Moretti | |
| 2010/0264166 | A1 | 10/2010 | Moretti | |

FOREIGN PATENT DOCUMENTS

| | | | |
|---|---|---|---|
| JP | H0575163 | U | 10/1993 |
| JP | 2003252338 | A | 9/2003 |
| JP | 2004161287 | A | 6/2004 |
| JP | 2011031938 | A | 2/2011 |
| WO | 2009047021 | A1 | 4/2009 |

* cited by examiner

DEVICE FOR CONTAINING A FLUID SUBSTANCE

Object of the present invention refers to a device for containing a fluid substance according to the pre-characterizing part of the main claim.

Nowadays devices for containing fluid substances are known which comprise a flexible bag provided with a rigid neck which is associated with a ring cap element. This latter is destined to be connected to the neck of an external rigid container, inside which the bag is inserted. An airless pump suitable to withdraw the fluid substance is associated with the device, and inserted at least partially in the rigid neck of the bag.

Such a device is illustrated in application EP2197589, on behalf of the applicant, wherein the pump is supported by a ring cap element. This latter provides an internal thread suitable to cooperate with a thread provided on the neck of the external container. The neck of the bag has an annular flange which engages an upper annular element of the internal thread of the ring cap element, so that when the ring cap element is taken away from the container, the bag is extracted from the external container together with the ring cap element.

A drawback of the above-mentioned known device is that the upper annular element does not allow a reliable coupling of the bag with the ring cap, such as to steadily fasten the neck of the bag to the ring cap element.

Patent application EP2243557 discloses a container for containing and dispensing a fluid substance, provided with a bag inserted in an external container, and from the neck of which extends a flange arranged in use in a ring cap element, connected to the neck of the external container. The pump is carried by a sheath element connected to the ring cap element, and suitable to maintain the flange of the neck of the bag in a predetermined position in the ring cap element.

Such a system with a ring cap element and a sheath element can be adapted to containers having a neck with a widened transverse dimension, as illustrated in the patent application MI2014A000561.

But this system does not fully satisfy the exigencies of the field, particularly referring to the stability of the connection between the flange of the bag and the ring cap element. In fact, with the above-mentioned system, it turns out to be still easy to disconnect the neck of the bag from the ring cap element.

Moreover assembling this system is laborious because it provides to associate the bag with the ring cap element before the bag is inflated.

Patent application JP 2003252338 discloses a container for refills wherein a bag is provided with a neck provided with a connection flange. The flange is click connected to a corresponding housing seat of a ring cap. In order to allow the click connection, the aforesaid seat presents a rest surface beneath which a conical wall extends. It results therefrom that the effective thickness below the rest surface is too thin for allowing a stable connection between the flange of the bag and the corresponding seat. In fact, drawing on the ring cap it is probable that the flange exits from the seat, provoking the detachment of the bag from the ring cap.

Patent application JP 2011031938 discloses a container comprising a bag, wherein the substance to be dispensed is inserted, and provided with a neck from which extends a flange. The container also comprises a ring cap for connecting the bag to a dispense member, the ring cap comprising a seat for connecting the ring cap and the bag. In this document as well, the seat comprises a rest surface for the flange, beneath which extend a conical wall, which means that the diameter of this wall at the rest surface is visibly different from the diameter at the lower edge of the same wall. Moreover, such conical wall acts as a guide element for helping the click connection of the flange to the corresponding seat in the ring cap, but does not comprise specific guide elements to this end. The conical shape of the wall determines that the seat for the flange has a thickness which is too small for allowing a stable connection between the bag and the ring cap. A scope of the present invention is therefore that of realizing a device for containing a fluid substance wherein the coupling between the neck of the bag and the ring cap element is able to warrant a stable and reliable connection of the bag to the ring cap, in particular when once the fluid contained in the bag is exhausted, one wants to remove the ring cap from the rigid container with which it is associated and one wants that in such an operation the bag remains stably fastened to the ring cap.

Another scope of the invention is that of realizing a device for containing a fluid substance which allows a fast and simple assembling of the bag to the ring cap element, even when the bag has already been inflated.

These scopes and other ones are reached by a device for containing a fluid substance realized according to the technical teachings of the attached claims.

Further features and advantages of the invention will be evident from the description of a preferred but not exclusive embodiment of the device for containing a fluid substance, illustrated as a not limitative example in the attached drawings, wherein.

Figure 1:
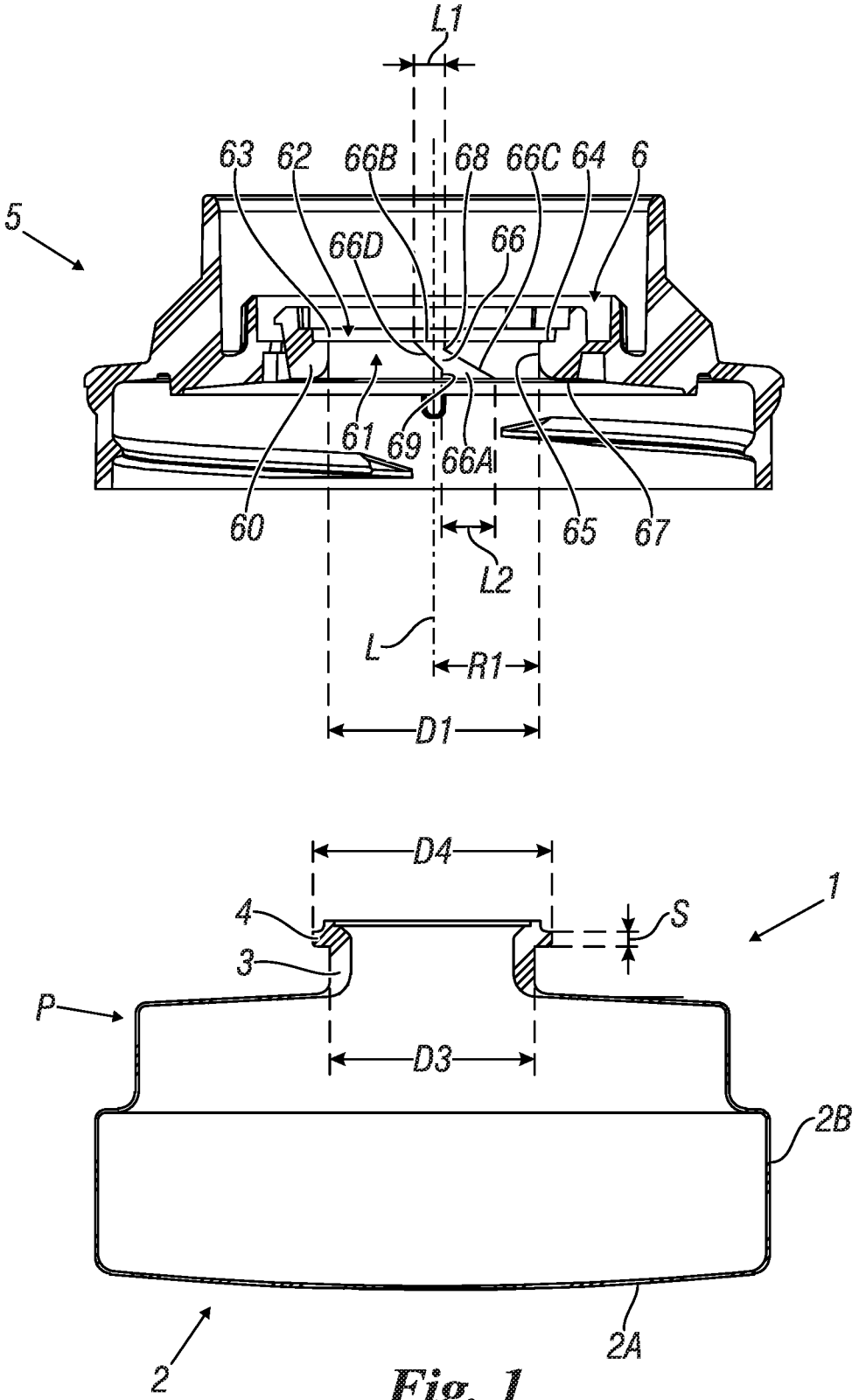
FIG. 1 is a transverse section view of the device according to the invention, wherein the components are disassembled.

Referring to the cited figures, they show a device for containing a fluid substance, the fluid substance being to be dispensed by means of a manually operated pump. In particular the device is suitable to be connected to the neck 10A of a rigid container 10.

The device for containing a fluid substance comprises

- a bag 1 having a body 2 comprising a bottom wall 2A and a lateral wall 2B, both of them being flexible, and a neck 3 from which a rigid connection flange 4 extends transversally,
- and a ring cap element 5 comprising first connection means 6 for connecting said bag 1 having an annular connection body 60, which presents on its turn a longitudinal symmetry axis L.

The bag 1 can be realized in any flexible material suitable to contain a fluid substance, such as for example aluminum of plastics, but is preferably realized in thermoplastic material.

The connection flange 4 of the bag 1 is suitable to be, in use, rested on a surface 64 which will be described in detail in the following. In the context of the present invention, with a flange which extends transversally it is intended a flange which extends in a not longitudinal direction with respect to the neck 3 of the bag 1, such as to provide such a surface as to enable the rest thereof on a rest surface.

In FIG. 1 the connection flange 4 is illustrated perpendicular to the neck 3 of the bag 1, but it is possible to provide a connection flange 4 which is inclined with respect to the same neck 3, for example by an angle of 45°.

Furthermore, the device for containing a fluid substance is suitable to be connected to a pump member 20 (FIG. 2), suitable to create in the bag 1 a depression (with respect to the room pressure) comprised between around 400 and 800 millibar, and more preferably equal to around 600 millibar. In this range of pressures the bag 1 is completely deformed or collapsed, while the flange 4 can be, at most, slightly curved, but substantially it is not deformed. Therefore in the present context with flexible walls it is intended walls which are completely collapsed at the above pressures created by the pump member, while with rigid flange is intended a flange which is not deformed at the above-mentioned pressures.

On its turn, the annular connection body 60 of the ring cap element 5 presents:

- a lower portion 61 having a diameter D1 smaller than the external diameter D4 of said flange 4 of the bag 1, and greater than or equal to the external diameter D3 of the neck 3 of the bag 1 such as to allow to house at least a portion of the neck 3 of the bag 1,
- and an upper portion 62 presenting an annular seat 63 open at the top, presenting a rest surface 64 lying horizontally for said connection flange 4.

According to the present invention, the connection body 60 of the ring cap element 5 further comprises at least one portion 65 of a substantially cylindrical wall. The portion 65 of the substantially cylindrical wall presents an equal distance R1 with respect to the longitudinal symmetry axis L, wherein the wall extends beneath said annular seat 63. The wall comprises at least a guide element 66 comprising at least a guide portion. The guide portion is a different distance than than distance R1 with respect to longitudinal symmetry axis L. The guide portion is suitable to guide at least a portion of the flange 4 from a free lower edge 67 of the connection body 60 to the annular seat 63.

It is to be pointed out that with substantially cylindrical wall it is intended a wall the distance R1 of which with respect to the symmetry axis L is substantially constant from the upper edge of the aforesaid wall to its lower edge. In the illustrated example, the lower edge of the substantially cylindrical wall has a rounded portion, but above this rounded portion, the substantially cylindrical wall has a distance R1 constant with respect to the symmetry axis L.

The guide element 66 also comprises means 68 suitable to prevent the flange 4 from slipping out of the annular seat once it has been guided therein, so that the connection means 6 fasten stably the bag 1 to the ring cap element 5 at least with respect to vertical movements or downwards rotatory movements of said bag 1 with respect to the ring cap element 5.

Such means 68 suitable to prevent the flange 4 from slipping out of the annular seat 63 make the connection between the bag 1 and the ring cap element 5 such that it is extremely difficult to separate the bag 1 (in particular the connection flange 4) from the ring cap element 5 (in particular from the annular seat 63). Such an extremely stable connection is also due to the fact that the connection flange 4 is substantially rigid.

In the example illustrated in FIG. 1, such means 68 suitable to prevent the flange 4 from slipping out of the annular seat 63 comprise a restriction element 68 arranged inside the guide element 66 in proximity of the annular seat 63, so as to restrict the width of the guide element 66 in proximity of the annular seat 63, so as to prevent the flange 4 from entering back in the guide element 66. Obviously the width must remain greater than the thickness of the connection flange 4, so as not to block the insertion thereof until the annular seat 63. In alternative, it is possible to provide other types of means suitable to prevent the flange 4 from slipping out of the annular seat 63, such as for example a closure element for closing the guide element 66.

Furthermore, the guide element 66 comprises at least a lateral wall 66C, 66D at least a portion of which is inclined with respect to both the longitudinal symmetry axis L of the connection body 60, and the rest surface 64 for the flange 4 of the neck 3 of the bag 1.

It is preferable that both the lateral walls 66C, 66D have at least an inclined portion with respect to both the longitudinal symmetry axis L of the connection body 60, and to the rest surface 64 for the flange 4 of the neck 3 of the bag 1, as in the example illustrated in the figures.

This feature allows to insert easily the flange 4 in the annular seat 63 with the help of the guide element 66, maintaining a stable connection between the flange 4 and the annular seat 63.

According to an advantageous aspect of the invention, the guide element 66 is inclined, with respect to the rest surface 64, and extends from an inlet mouth 66A for the flange 4, provided at the free lower edge 67 of the connection body 60, to an outlet mouth 66B provided in the annular seat 63. Those two mouths 66A, 66B are angularly distanced from each other by an angle smaller than the half of the circumference of the substantially cylindrical wall, preferably smaller than a quarter of the circumference, and more preferably smaller than one third of the circumference of the substantially cylindrical wall.

More precisely, the guide element 66 extends from the inlet mouth 66A to the outlet mouth 66B following a substantially rectilinear path. Such a substantially rectilinear path is very advantageous for the insertion of the flange 4, in particular because this latter is rigid.

It is preferable that the aforesaid inclined portion of the lateral wall 66C, 66D extends until at least one between the inlet mouth 66A and the outlet mouth 66B.

Preferably, the free lower edge 67 of the connection body 60 is substantially parallel to the rest surface 64 of the annular seat 63.

In the example illustrated in FIG. 1, the restriction element 68 consists in a triangular tooth which extends in the prolongation of a first lateral surface 66C of the guide element 66 towards a second lateral surface 66D.

It is to be noted that, in a preferable way, the first and the second lateral surface 66C, 66D of the guide element 66 have inclinations different from each other in such a way that the outlet mouth 66B results narrower with respect to the inlet mouth 66A. It is possible to provide that this feature taken alone constitutes the aforesaid means suitable to prevent the flange 4 from slipping out of the annular seat 63. In such a case, it is suitable that the width L1 (FIG. 1) of the outlet mouth 66B is substantially equal to or slightly greater (for example 20% greater) than the thickness S of the connection flange 4.

It is to be noted that, in a preferable way, the second lateral wall 66D, less inclined than the first one, comprises in proximity of the inlet mouth 66A a widening portion 69 so as to make the entering of the flange 4 easier. Preferably the inlet mouth 66A has a width L2 at least 30% greater with respect to the width L1 of the outlet mouth 66B.

Such a widening portion 69 preferably consists in a portion of the second lateral wall 66D provided substantially perpendicular to the lower free edge 67 of the connection body 60.

Advantageously, in the example illustrated in FIG. 1, the guide element 66 is a hollow portion provided in the cylindrical wall of the connection body 60. In alternative, it is possible to provide that the guide element 66 is delimited by a couple of elements which protrude from the same cylindrical wall. In both cases, the presence of the guide element 66 determines the delimitation of at least one portion 65 of the cylindrical wall which presents a distance R1 substantially constant with respect to the longitudinal symmetry axis L of the connection body 60. Obviously, the presence of more than one guide element 66 determines the delimitation of more than one portion 65 of the substantially cylindrical wall. All the portions 65 present the same distance R1 with respect to the longitudinal symmetry axis L.

According to a preferred aspect of the invention, second connection means 7, suitable to stably block the connection flange 4 in the seat 63 by compression of the flange 4 against the rest surface 64 of the annular seat 63, are provided.

Preferably, the above said second connection means 7 are associated with a sheath element 8 connected to the manually operated pump member 20. The sheath element 8 comprises further connection means 9 for connecting said sheath element 8 to said ring cap element 5, suitable to position a portion of the pump member 20 at least one the neck 3 of the bag 1, in order to withdraw a fluid substance present in the bag 1 and feed it to the outside through a dispense stem 21 of the pump member 20.

Figure 2:
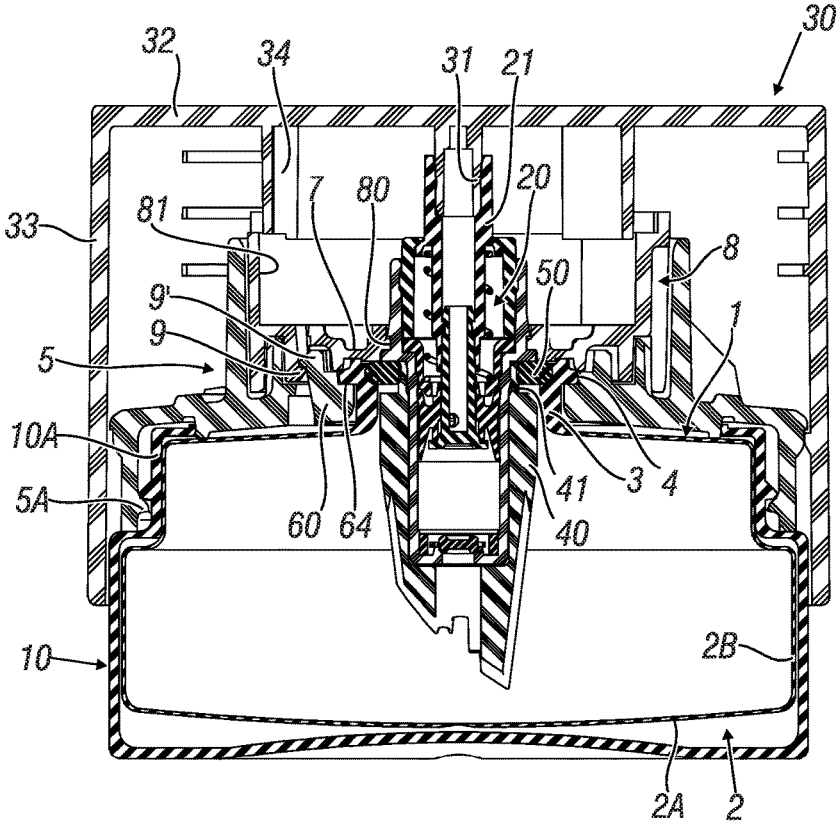
FIG. 2 is a transverse section view of a dispense system comprising the device of FIG. 1.

The ring cap element 5 is preferably provided with connection counter-means 9' which cooperate in use with the further connection means 9 of the sheath element 8, as illustrated in FIG. 2.

The device for containing a fluid substance described above is suitable to assembled in a dispense system illustrated in FIG. 2.

Such a dispense system comprises, in addition to the above device, a rigid container 10 with which the device is to be associated, wherein the rigid container 10 has a neck 10A delimiting an access opening to a cavity of the same container 10.

Preferably, the dispense system also comprises a pump member 20 connected to the sheath element 8 in a corresponding annular seat 80 and partially inserted in the neck 3 of the bag 1, and a dispense cap 30 provided with an internal sleeve 31 suitable to be connected to the dispense stem 21 of the pump member 20, in a conventional manner for the person skilled in the art. The internal sleeve 31 is connected to a pipe, connected on its turn to a dispense opening of the dispense cap 30, the pipe and the dispense opening are not illustrated in the figures.

In the dispense system, the device is connected to the external container 10 so that the bag 1 is inserted in the cavity of the external container 10. More precisely the ring cap member 5 is connected to the neck 10A of the external container 10. To this end, the ring cap element 5 is provided with connection means 5A for connecting to the neck 10A of the rigid external container 10, which on its turn is provided with connection counter-means 10B suitable to cooperate with the aforesaid connection means 5A.

Preferably the dispense cap 30 comprises an upper wall 32, on the internal surface of which the aforesaid sleeve 31 is provided, and from which extends at least one lateral mantle 33, as well as an internal guide element 34 arranged on the internal surface of the upper wall 32, and suitable to cooperate with a guide counter-element 81 provided on the sheath element 8.

In the example of FIG. 2 the upper wall 32 of the dispense cap 30 has a transverse dimension greater than or equal to the transverse dimension of the rigid container 10 while the lateral mantle 33 has a length such as to cover the device for containing the fluid substance. Obviously it is possible to provide a dispense cap 30 with shape and dimension different from what is illustrated in FIG. 2.

Advantageously, a dip tube element 40 is connected to the pump member 20 and inserted inside the body 2 of the bag 1, so as to be immerged in the fluid substance to be dispensed.

In the example of FIG. 2, the pump member 20 is of the airless type, and is hermetically inserted in the neck 3 of the bag 1 by means of a tight member 50 inserted in an upper portion 41 of the dip tube element 40, the upper portion 41 being directly connected to the body of the pump member 20. Obviously, it is possible to provide a different position of the tight member 50, which can be inserted directly about the body of the pump member 20.

It is specified that the rigid external container 10 can be made in any rigid material, preferably in glass or plastics.

The functioning of the invention is as follows, and provides:

- a step of shaping a bag 1 (FIG. 3),
- a step of at least deformation of the bag 1 for reducing the transverse dimension thereof (FIGS. 4 and 5),
- a step wherein the deformed bag 1 is connected to the ring cap element 5 (FIGS. 6 to 8), such as to stably fasten the deformed bag 1 to the ring cap element 5 at least with respect to vertical movements or downwards rotatory movements of the bag 1 with respect to the ring cap element 5,
- and a further step, following the above said connection step, wherein the ring cap element 5 is associated with the neck 10A of the rigid container 10 and the deformed bag 1 is simultaneously inserted in said cavity of the rigid container 10.

Preferably, in order to associate the bag 1 with the ring cap element 5, these latter are inclined with respect to each other, so as to allow the insertion of the flange 4 in the guide element 66 and then in the annular seat 63. This inclination, in fact, makes the insertion of the flange 4 in the guide element 66 easier, as can be seen in particular in FIGS. 8 and 9.

Figure 6:
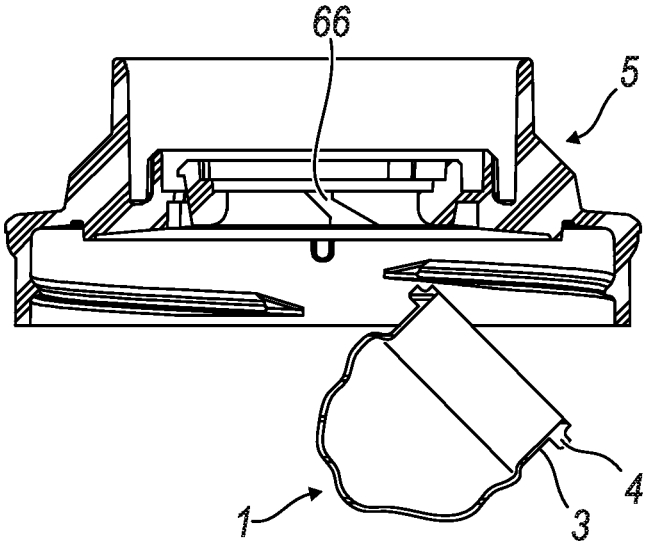
Figure 7:
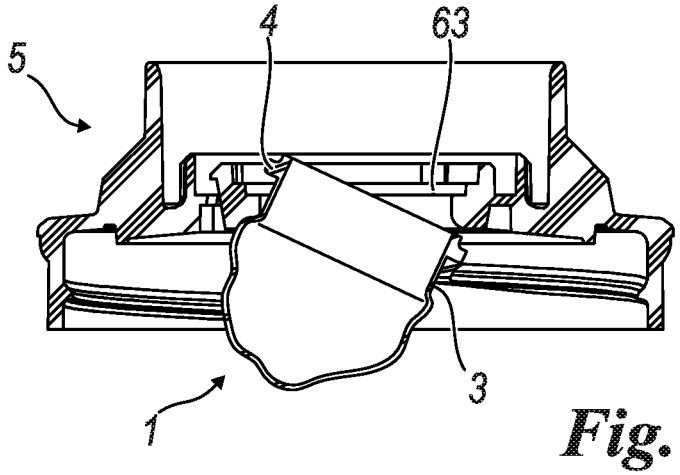
Figure 8:
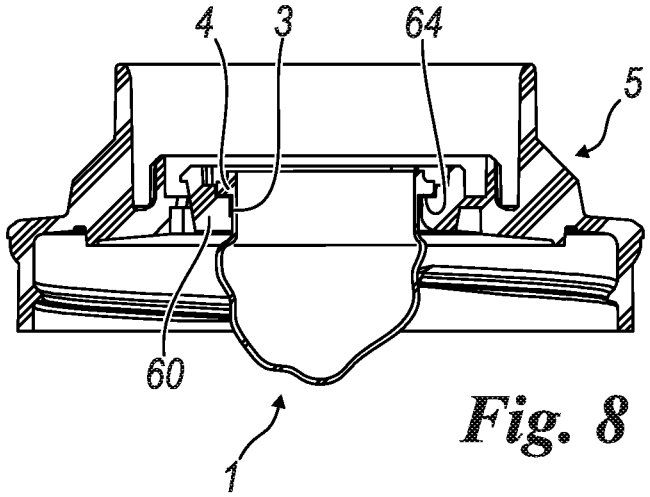
Figure 9:
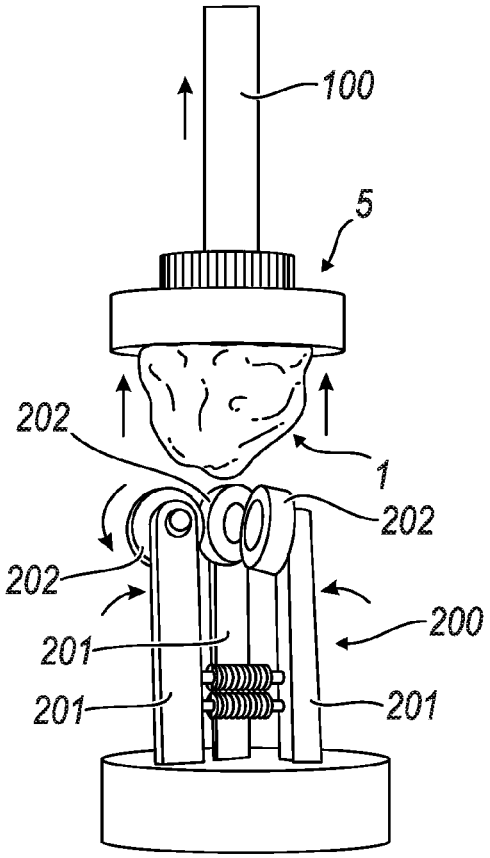
FIGS. 9 to 12 are scheme views of further successive step of the assembling of the dispense system of FIG. 2.

More precisely, in a preferable manner, the bag 1 and the ring cap element 5 are inclined with respect to each other (FIG. 6). Successively the flange 4 is partially inserted in the guide element 66, in a way as to insert partially the neck 3 of the bag 1 in the annular seat 63 of the connection body 60 (FIG. 7). Then, the insertion of the neck 3 of the bag 1 in the annular seat 63 is completed (FIG. 8).

In a particularly advantageous way, it is possible to provide that, in order to complete the insertion of the neck 3 in the annular seat 63, is operated a rotation of the neck 3 of the bag 1 or of the ring cap element 5 with respect to each other.

In an advantageous embodiment of the assembling method, the step of at least partial deformation of the bag 1 provides to press on the internal surface of the bottom wall 2A of the body 2 of the bag 1 in a way as to extend it. Successively one presses on at least two areas of the external surface of the lateral wall 2B of the body 2 of the bag 1 so as to reduce the lateral dimensions of the bag 1.

Figure 3:
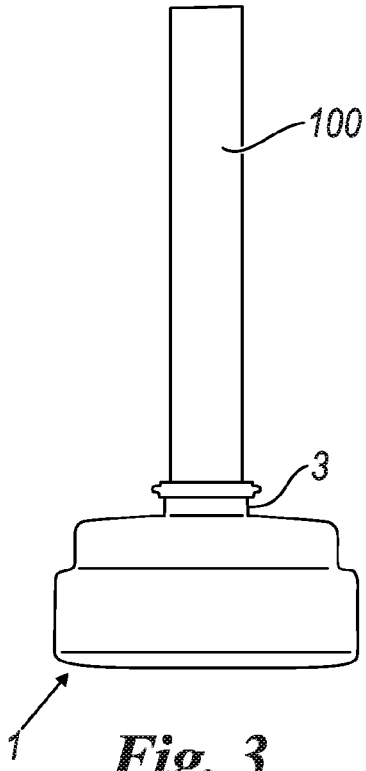
FIGS. 3 and 4 are scheme views of successive steps of assembling of the dispense system of FIG. 2.

As can be seen in FIGS. 3 to 6, 11 and 12, it is opportune to provide a stem 100 comprising an internal through channel connected to means suitable to suction and feed air inside the bag 1. With this stem 100, one provides to operate the aforesaid pressure on the bottom wall 2A of the bag 1 (FIG. 3).

The pressure on the external surface of the lateral wall is preferably operated by a jaw device 200 (FIGS. 4 and 9) provided with at least two arms 201 provided with respective squeeze elements 202 at a free end. In the illustrated example, and in a preferable way, the device 200 comprises three arms 201.

Figure 4:
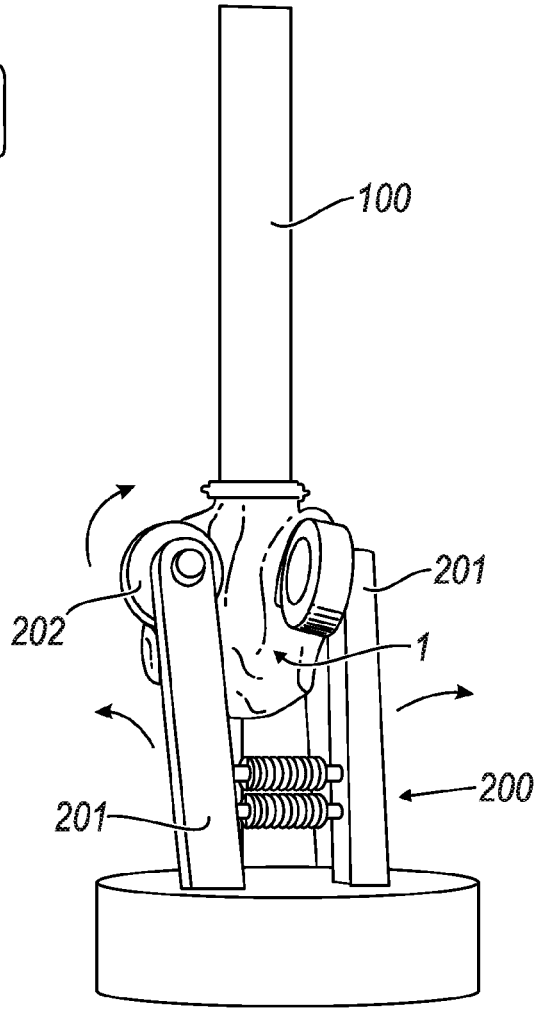
Figure 5:
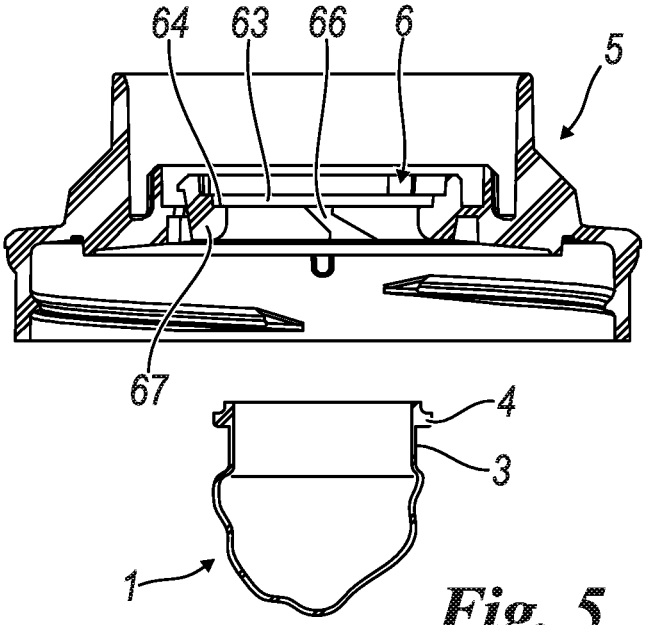
FIGS. 5 to 8 are scheme transverse section views of successive steps of the assembling of the device of FIG. 1.

Advantageously, the squeeze elements 202 comprise idle wheels, so as to be able to be displaced along the lateral wall 2B of the bag during their squeezing. Doing so one can operate easily the squeezing of the lateral wall 2B of the bag 1 from the bottom wall 2A substantially until to the neck (FIG. 4). Preferably the jaw device 200 is suitable to deform the portion P (FIG. 1) of the bag 1 immediately below the neck 3 of the bag 1.

At this point it results particularly advantageous to apply a decompression inside the deformed bag 1. This decompression allows to further reduce the lateral dimensions of the bag 1. As mentioned above, the stem 100 is preferably connected to means suitable to operate such decompression.

Figure 10:
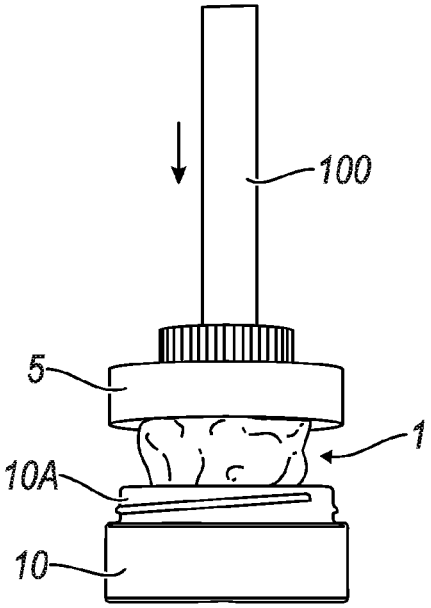

It is also possible to maintain the above said decompression inside the bag 1 deformed during the step of inserting the bag 1 in the container 10 (FIGS. 9 and 10), so as to maintain the bag 1 in its deformed condition and so make easier its insertion in the container 10.

It is to be underlined that in FIGS. 5 to 8 the bag is shown only partially deformed and lacking the stem 100.

Figure 11:
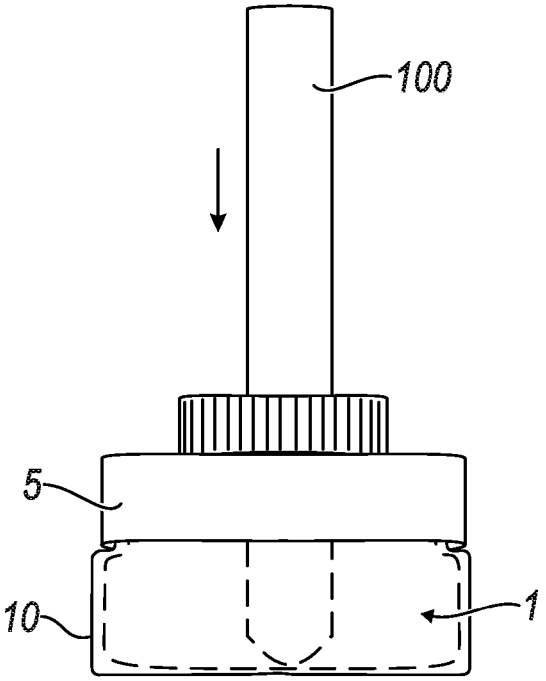

Preferably, the bag 1, after the insertion in the rigid container 10, is inflated by means of the stem 100 (FIG. 11).

Figure 12:
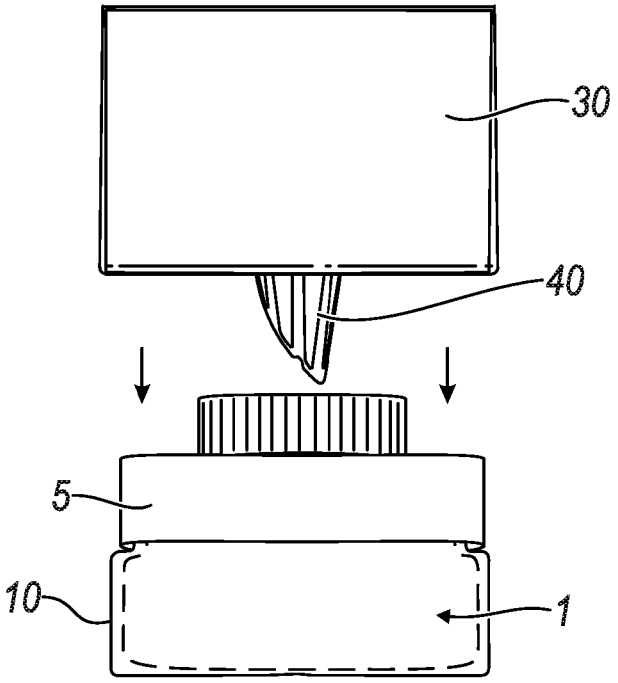

Preferably, for completing the assembling of the dispense system, the sheath element 8, the pump member 20 provided with the dip tube element, and the dispense cap 30, preferably previously already mounted together, are connected to the ring cap element 5 mounted on the rigid container 10, as illustrated in FIG. 12.

The invention claimed is:

1. A device for containing a fluid substance, to be dispensed by a manually operated pump, and suitable to be associated with the neck of a rigid container, comprising:

a bag presenting a body comprising a bottom wall and a lateral wall, both of the bottom wall and the lateral wall being flexible, and a neck from which a substantially rigid connection flange extends transversally, and a ring cap element comprising first connection means of said bag presenting an annular connection body, presenting a longitudinal symmetry axis, wherein said annular connection body presents a lower portion having a diameter smaller than the external diameter of said substantially rigid connection flange of the bag, and greater than or equal to the external diameter of said neck of the bag to be able to house at least a portion of said neck of the bag therein, and an upper portion presenting an annular seat open at the top, presenting a rest surface lying horizontally for said substantially rigid connection flange, wherein said annular connection body further comprises at least one portion of a substantially cylindrical wall, said portion presenting an equal distance with respect to said longitudinal symmetry axis, said substantially cylindrical wall extending beneath said annular seat, said substantially cylindrical wall comprising at least a guide element comprising at least a guide portion presenting a distance with respect to said longitudinal symmetry axis different with respect to said distance of the portion of the substantially cylindrical wall, said portion being suitable to guide at least a portion of said substantially rigid connection flange from a free lower edge of said annular connection body to said annular seat, and wherein said guide element comprises means suitable to prevent said substantially rigid connection flange from slipping out of said annular seat once the substantially rigid connection flange has been guided therein, so said connection means fasten stably said bag to said ring cap element at least with respect to vertical movements or downwards rotatory movements of said bag with respect to the ring cap element.

2. The device according to claim 1, wherein the guide element is inclined and extends from an inlet mouth for said substantially rigid connection flange, arranged at the free lower edge of the annular connection body, to an outlet mouth arranged in the annular seat, and wherein both mouths of the guide element are angularly distanced from each other by an angle smaller than half the circumference of the substantially cylindrical wall.

3. The device according to claim 1, wherein said guide element is a hollow portion provided in the substantially cylindrical wall of the annular connection body.

4. The device according to claim 1, wherein second connection means are provided, suitable to stably block the substantially rigid connection flange of the bag in the annular seat of the ring cap element by compression of the substantially rigid connection flange against the rest surface of said annular seat.

5. The device according to claim 4, wherein the second connection means are associated with a sheath element connected to a manually operated pump member, wherein said sheath element is connected to said ring cap element, and wherein a portion of the pump member is positioned at least in the neck of said bag.

6. The device according to claim 2, wherein the guide element presents a first lateral wall and a second lateral wall, said first and said second lateral walls of the guide element having inclinations different from each other in such a way that the outlet mouth results narrower with respect to the inlet mouth.

7. The device according to claim 2, wherein the outlet mouth presents a width substantially equal to or slightly greater than the thickness of the substantially rigid connection flange, the second lateral wall being provided with a widening portion in proximity of the inlet mouth so said inlet mouth presents a width at least 30% greater with respect to said width of said outlet mouth.

8. A method for assembling a dispense system comprising:

a device according to claim 1, and a rigid container with which said device is to be associated, wherein said rigid container presents a neck delimiting an access opening to a cavity of the same container, wherein the method provides forming a bag, at least partially deforming the bag to reduce the transverse dimensions thereof, connecting the deformed bag to the ring cap element, to fasten stably said deformed bag to said ring cap element at least with respect to vertical movements or downwards rotatory movements of said bag with respect to the ring cap element, and, successive to connecting, associating the ring cap element to the neck of said rigid container and simultaneously inserting the deformed bag in said cavity of the rigid container.

9. The method according to claim 8, wherein to associate said deformed bag with said ring cap element, the deformed bag and said ring cap element are inclined with respect to each other, to allow the insertion of the substantially rigid connection flange in a guide element of the ring cap element and then in an annular seat of the ring cap element.

10. The method according to claim 8, wherein said bag, after insertion in said rigid container, is inflated.

11. The device according to claim 1, wherein the guide element is inclined and extends from an inlet mouth for said substantially rigid connection flange, arranged at the free lower edge of the annular connection body, to an outlet mouth arranged in the annular seat, and both mouths of the guide element are angularly distanced from each other by an angle smaller than a quarter of the circumference of the substantially cylindrical wall.

12. The device according to claim 1, wherein the guide element is inclined and extends from an inlet mouth for said substantially rigid connection flange, arranged at the free lower edge of the annular connection body, to an outlet mouth arranged in the annular seat, and both mouths of the guide element are angularly distanced from each other by an angle smaller than a third of the circumference of said substantially cylindrical wall.

13. The device according to claim 6, wherein the outlet mouth presents a width substantially equal to or slightly greater than the thickness of the substantially rigid connection flange, the second lateral wall being provided with a widening portion in proximity of the inlet mouth so said inlet mouth presents a width at least 30% greater with respect to said width of said outlet mouth.

* * * * *